US007629954B2

(12) United States Patent
Wang et al.

(10) Patent No.: US 7,629,954 B2
(45) Date of Patent: Dec. 8, 2009

(54) STRUCTURE AND DRIVING METHOD FOR ACTIVE PHOTOELECTRIC ELEMENT

(75) Inventors: Wen-Chun Wang, Taichung (TW); Henta Kang, Taichung (TW); Yi-Chin Wang, Taichung County (TW)

(73) Assignee: Wintek Corporation, Taichung (TW)

( * ) Notice: Subject to any disclaimer, the term of this patent is extended or adjusted under 35 U.S.C. 154(b) by 652 days.

(21) Appl. No.: 11/387,850

(22) Filed: Mar. 24, 2006

(65) Prior Publication Data

US 2007/0222725 A1 Sep. 27, 2007

(51) Int. Cl.
*G09G 3/36* (2006.01)

(52) U.S. Cl. ..... 345/91; 345/87

(58) Field of Classification Search ..... 345/87–91, 345/55–100, 204–214, 690–697; 349/50–52
See application file for complete search history.

(56) References Cited

U.S. PATENT DOCUMENTS 4,731,610 A * 3/1988 Baron et al. ..... 345/91
4,810,059 A * 3/1989 Kuijk ..... 345/91
5,898,416 A * 4/1999 Kuijk et al. ..... 345/90
6,008,872 A * 12/1999 den Boer et al. ..... 349/106
6,222,596 B1 * 4/2001 Veerasamy ..... 349/50
6,225,968 B1 * 5/2001 den Boer et al. ..... 345/91
2005/0083283 A1 * 4/2005 Boer ..... 345/87
2005/0225543 A1 * 10/2005 Boer ..... 345/204

* cited by examiner

*Primary Examiner*—David L Lewis
(74) *Attorney, Agent, or Firm*—Muncy, Geissler, Olds & Lowe, PLLC

(57) ABSTRACT

A structure and driving method for active photoelectric element that aims to every matrix-arranged pixel on the display panel. The pixel structure includes a set of first thin film diodes and a set of second thin film diodes. The first set and the second set of film diodes are connected at a node. The electrical impedances of the first set and the second set of film diodes are unsymmetrical. The first set of film diodes connects to the select lines of the pixel while the second set of film diodes connects to the select lines of the pixel on the next row, which forms a configuration that the up/down pixels share one select line. Consequently, the driving signal for the up select line of a single pixel is determined by the driving signal for the down select line of the up pixel so as to reduce the quantity of select lines.

4 Claims, 5 Drawing Sheets

STRUCTURE AND DRIVING METHOD FOR ACTIVE PHOTOELECTRIC ELEMENT

FIELD OF THE INVENTION

The present invention relates to a structure and driving method for an active photoelectric element. By way of the unsymmetrical configuration for diodes and the up/down pixels share one select line in a single pixel, and collocating corresponding driving voltages to achieve the goals of voltage control and driving the liquid crystal to rotate.

BACKGROUND OF THE INVENTION

Compared a Thin Film Transistor Liquid Crystal Display (TFT LCD) with a Twisted-Nematic (TN) LCD or a Supertwisted-Nematic (STN) LCD, a TFT LCD is active driving so it has merits like good image quality, and quick response time. Therefore, TFT LCDs become the main fashion of LCDs gradually.

However, normally there are at least five steps of mask in the manufacturing process for a TFT array substrate so the manufacturing cost of an array substrate is higher than a traditional passive-matrix LCD.

Accordingly, people started to develop that using Metal-Insulator-Metal (MIM) thin film diodes to substitute TFTs. The thin film diode technology is developed by Seiko and Epson companies, which is specially used for display of mobile phones. Thin film diode is a compromise between TFT and STN. The brightness and the color saturation between thin film diode are better than STN's , and saves more power than TFT. The main characteristic is that thin film diode serves high image quality and the display easy to watch no matter under the condition of backlight-on (transmission mode) or backlight-off (reflect mode), and thin film diode has merits of low power consumption, high image quality, and quick response time.

A traditional MIM LCD does not need a storage capacitor. Every pixel only uses the liquid crystal capacitor of the pixel to be the storage device for data write-in such that the active matrix LCDs can be completed. Compared with the manufacturing process for TFTs, the manufacturing process for MIMs only needs 2~3 steps of masks and hence it has a very clear advantage of cost.

However, a traditional MIM LCD has the problems of image residual and not easy to control the gray scale. Accordingly, U.S. Pat. No. 6,222,596 disclosed a symmetrical MIM diodes arrangement in every utilized pixel. The method of using two scan lines to drive one pixel solves the problems of image residual and not easy to control the gray scale for a traditional MIM LCD.

In U.S. Pat. No. 6,222,596, every pixel structure of every row of pixels is shown in FIG. 1. Each pixel includes a common electrode 9, a pixel electrode 8, a liquid crystal layer 7 between the two electrodes of the common electrode 9, two sets of MIM diodes 10, 11 that are symmetrical to a connection point 12, a data line that connects to the common electrode 9, and the select lines 21 and 22 that respectively connect to the sets of MIM diodes 10, 11.

Every pixel of U.S. Pat. No. 6,222,596 has symmetrical MIM diodes, and each pixel is composed of a pair of select lines 21, 22 and a single data line 31. Due to the restriction of this design rule, the method of driving one pixel by a pair of select lines 21, 22 that used by U.S. Pat. No. 6,222,596 will reduce the effective emitting area (aperture rate) of each pixel relatively. Moreover, the following manufacturing process for IC bonding becomes a big problem because the quantity of whole channel increased. More ICs are needed to control all circuits, and larger area is needed such that there is enough space to design the control circuit. As a result, not only the circuit design becomes more complicated that affects the yield rates but also the needed IC parts are increased that increase the manufacturing cost.

SUMMARY OF THE INVENTION

Consequently, the main purpose of the present invention is to reduce half number of channels, compared with the traditional method that uses a pair of select lines to drive a pixel, by way of the unsymmetrical configuration for two sets of thin film diodes and the up/down pixels sharing one select line and collocating corresponding driving voltages. Reducing the number of channels will reduce the number of ICs. The following manufacturing process for IC bonding for panels becomes more convenient, the manufacturing cost is lowered effectively, the manufacturing difficulty is reduced, and the design complexity is also decreased.

Another purpose of the present invention is that the current invention reduces the quantity of channels effectively. Reducing the quantity of channels will promote the whole aperture rate and resolution.

The third purpose of the present invention is that the current invention reduces the quantity of channels effectively whereas the well-known problem of incomplete etching due to parallel arranged two select lines such that the yield rates can be promoted.

The present invention is a structure and driving method for an active photoelectric element that aims to every matrix-arranged pixel on the display panel. The pixel structure includes a common electrode, a pixel electrode, and a liquid crystal layer between the two electrodes, which form a pixel storage capacitor and the common electrode connecting to a data line. Besides, it includes a first set of thin film diodes and a set of second thin film diodes. The second set of thin film diodes is 1~5 times of the electrical impedance of the first set of thin film diodes The first set of thin film diodes and the second set of thin film diodes are connected at a node, and the pixel electrode also connects to the node. A select line and the data line are perpendicular to each other.

The other terminal of the first set of thin film diodes connects to the select line. The other terminal of the second set of thin film diodes connects to the select line of the pixel on the next row. A configuration that the up/down pixels sharing one select line is formed. The driving method is that the select signal of the select line is a positive/negative voltage. The ratio of the maximum absolute value of the positive/negative voltage value and the minimum absolute value of the positive/negative voltage value is defined as a positive number. Accordingly, the positive number is the electrical impedance ratio of the first set of thin film diodes and the second set of thin film diodes or the positive number is the electrical impedance ratio of the second set of thin film diodes and the first set of thin film diodes.

BRIEF DESCRIPTION FOR THE DRAWINGS

FIG. 1 is the schematic diagram for a pixel of U.S. Pat. No. 6,222,596.

DESCRIPTION OF THE PREFERRED EMBODIMENT

The detailed descriptions for content and technology of the present invention associate with figures are as follows.

Figure 1:
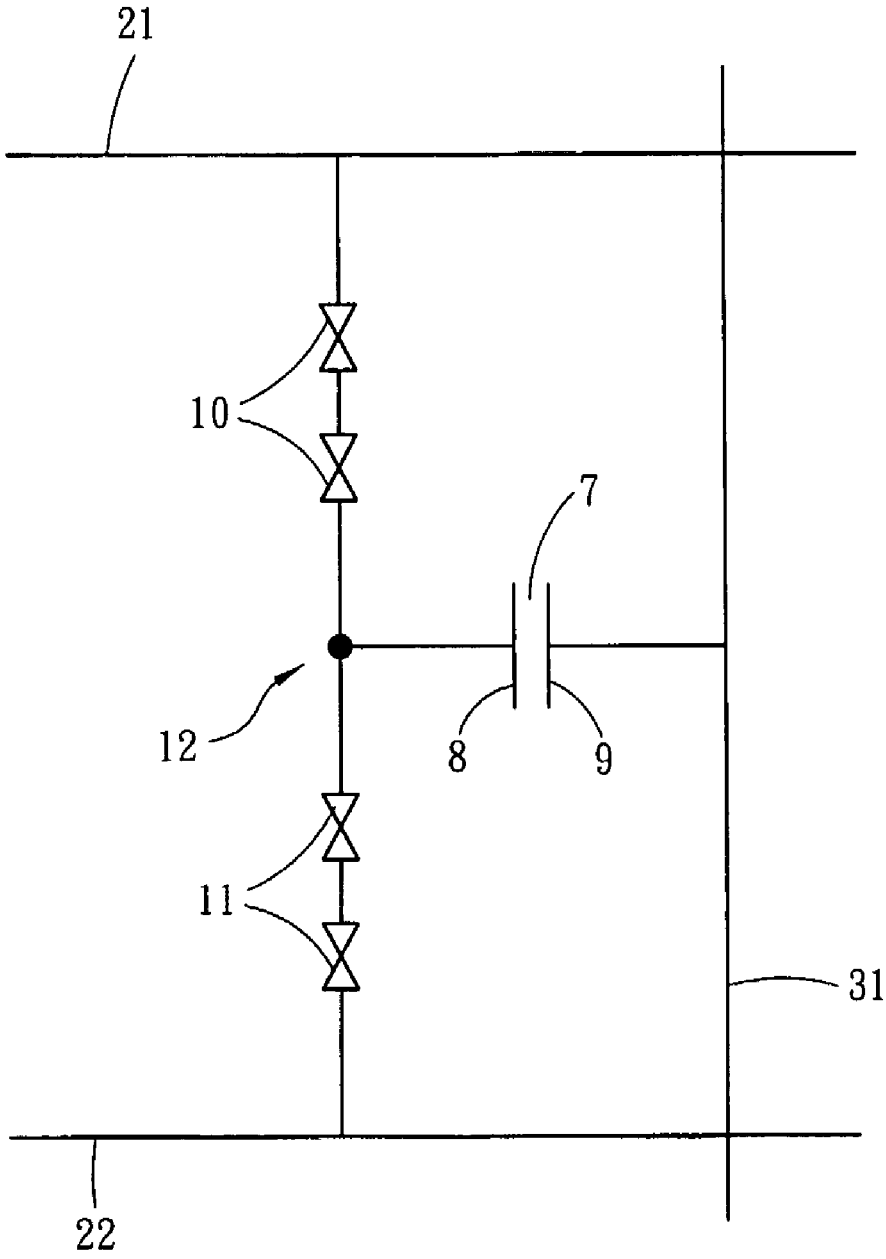
Fig . 1 PRIOR ART
Figure 2:
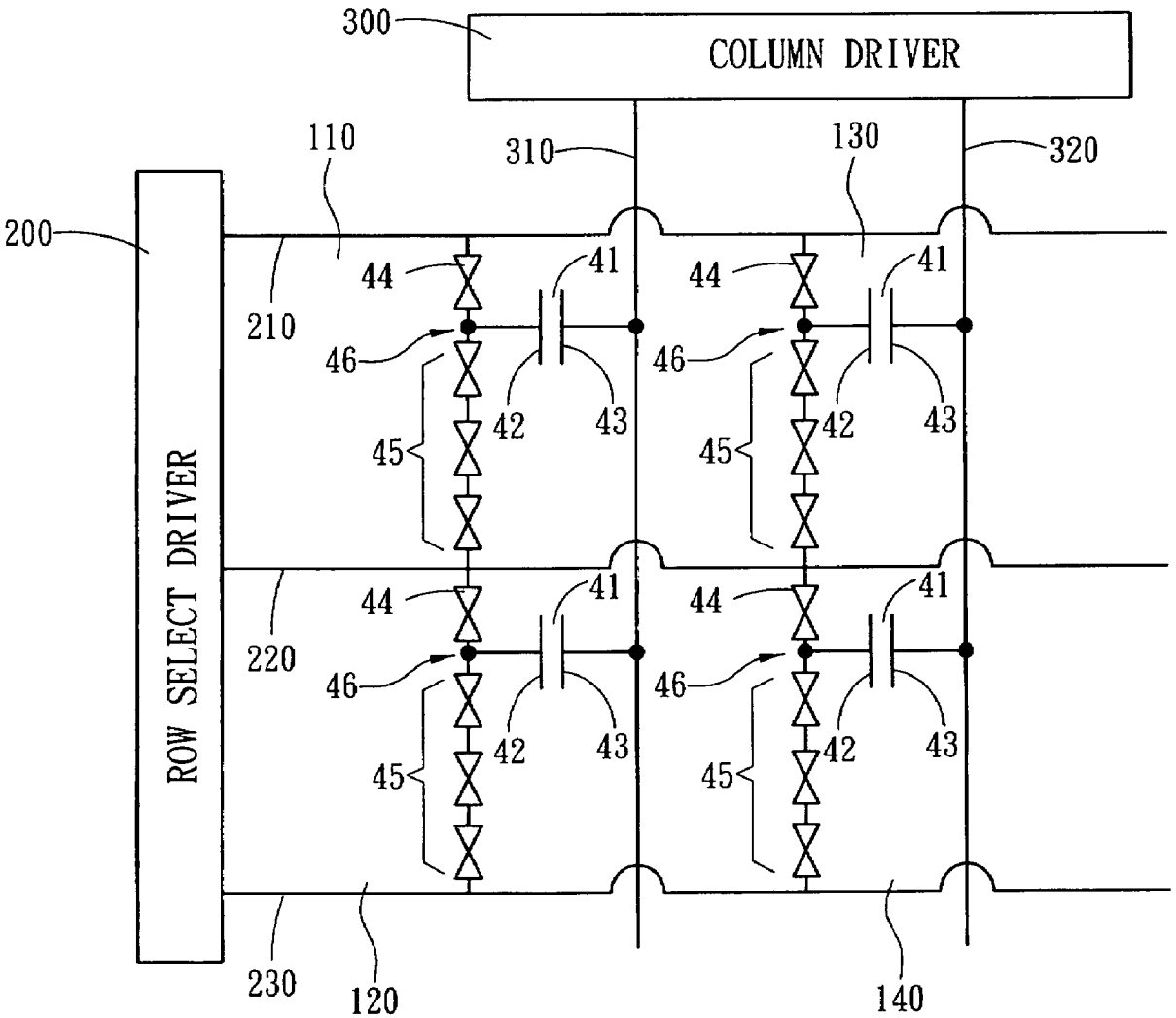
FIG. 2 is the schematic diagram for the circuit of the LCD device of the present invention.

Please refer to FIG. 2, which is the schematic diagram for the specific circuit design for the 2×2 active matrix panel of the present invention. Data lines 310 and 320 connect to a column-driving element 300, and select lines 210, 220, and 230 connect to a row-selecting element. All the data lines 310 and 320 are arranged as a column configuration and parallel to one another on the panel, all the select lines 210, 220, and 230 are arranged as a row configuration and parallel to one another on the panel. All the data lines 310, 320 and all the select lines 210, 220, and 230 are perpendicular to one another on the panel such that they crisscross construct pixels 110, 120, 130, and 140. Plural active matrix-arranged pixels 110, 120, 130, and 140 are thus constructed on the panel.

Each pixel of the matrix-arranged pixels 110, 120, 130, and 140 includes a common electrode 43 and a pixel electrode 42 (take the first pixel 110 of the upper-left corner as an example), and a liquid crystal layer 41 between the two electrodes, which forms a pixel storage capacitor, and the common electrode 43 connects to a data line 310. Moreover, a first set of film diodes 44 and a second set of film diodes 45, and the second set of film diodes 45 is 1~5 times of the electrical impedance of the first thin set film diodes 44. In other words, the electrical impedance of the second set of film diodes 45 is higher than one time and lower than five times of the electrical impedance of the first set of film diodes 44. The first set of film diodes 44 and the second set of film diodes 45 are connected at a node 46, and the pixel electrode 42 also connects to that node 46.

The select line 210 and the data line 310 are perpendicular to each other. The other terminal of the first set of film diodes 44 connects to the select line 210 while the other terminal of the second set of film diodes 45 connects to the select line 220 of the pixel 120 on the next row, which forms a configuration that the up/down pixels 110 and 120 sharing one select line 220.

The first set of film diodes 44 and the second set of film diodes 45 are nonlinear resistive diodes with a MIM structure. The MIM structure is built by coating. By way of the chemical vapor deposition to manufacture $SiN_x$, a nonlinear resistive diode with the $SiN_x$ structure is formed. Compare with a traditional diode structure, a nonlinear resistive diode with the MIM structure has better current-voltage (I-V) characteristic ratio and smaller capacitor area such that a single pixel has better aperture rate. The first set of film diodes 44 and the second set of film diodes 45 can be composed of a single thin film diode or plural thin film diodes. For example, the first set of film diodes 44 is a single thin film diode while the second set of film diode 45 is composed of three thin film diodes with the same specification. The structure that forms the second set of film diodes 45 is three times of the electrical impedance of the first set of film diodes 44.

The driving method of the present invention is that the select signal of the select line 210 is a positive/negative voltage. The ratio of the maximum absolute value of the positive/negative voltage value and the minimum absolute value of the positive/negative voltage value is defined as a positive number. Accordingly, the positive number is the electrical impedance ratio of the first set of thin film diodes and the second set of thin film diodes or the positive number is the electrical impedance ratio of the second set of thin film diodes and the first set of thin film diodes 44 and 45.

The present invention uses MIM nonlinear resistive diodes to drive every pixel of AMLCD. A single pixel is controlled by a pair of select lines and a data line, and the electrical impedance of the second set of film diodes 45 is higher than one time of and lower than five times of the electrical impedance of the first set of film diodes 44, which is an unsymmetrical configuration. The present invention uses the variation of the structure characteristics of MIM diodes to control the voltage and driving the liquid crystal.

Figure 3:
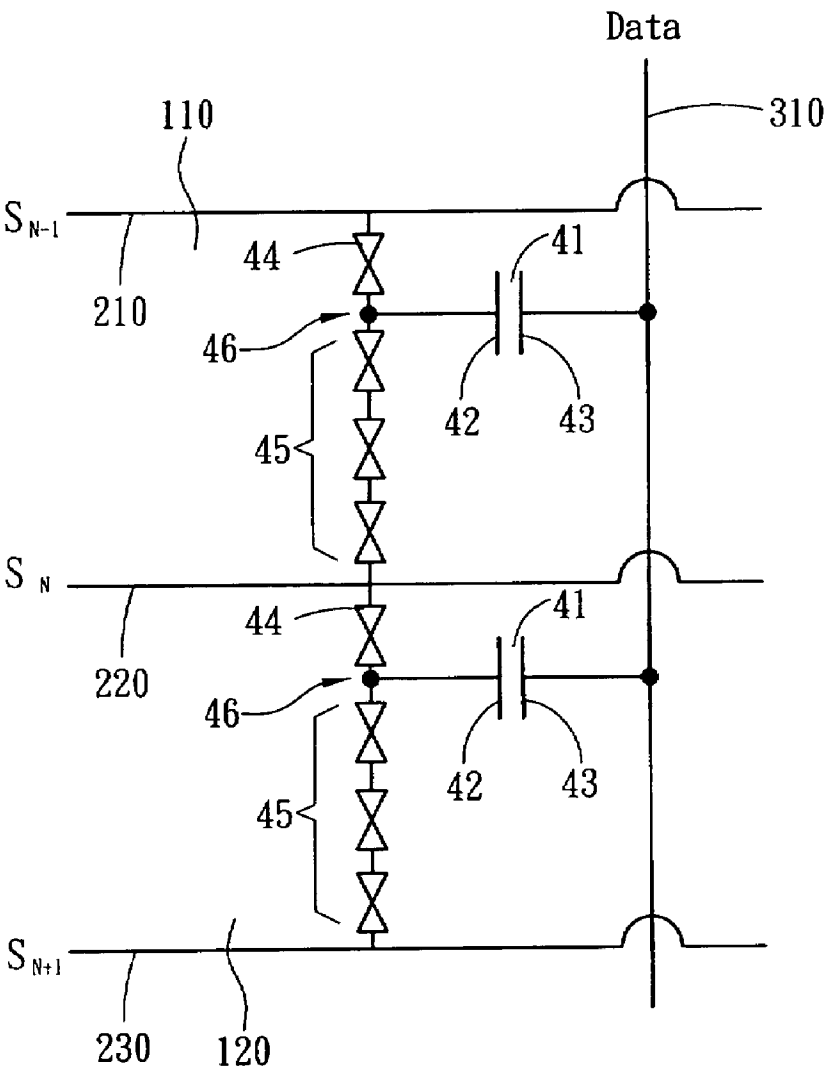
FIG. 3 is the schematic diagram for the structure of up/down adjacent pixels of the present invention.

As shown in FIG. 3, when the up/down select lines 210 and 220 of the first pixel 110 are respectively input select signals $S_{N-1}$ and $S_N$ to drive the first pixel 110, inputting the data from data line 310 can drive the first pixel 110 to function. When driving the second pixel 120, the select signals $S_N$ and $S_{N+1}$ on the up/down select lines 220 and 230 of the second pixel 120 are used to drive. Consequently, the select signal of the select line accepted by the first thin film diode 44 of a single pixel is determined by the select signal of the down select line of the up pixel, i.e. when inputting the data for driving every pixel, one terminal of the first thin film diode 44 is provided by the last select line, and the select line of the other terminal of the first thin film diode will be offered to drive the next pixel.

Figure 4:
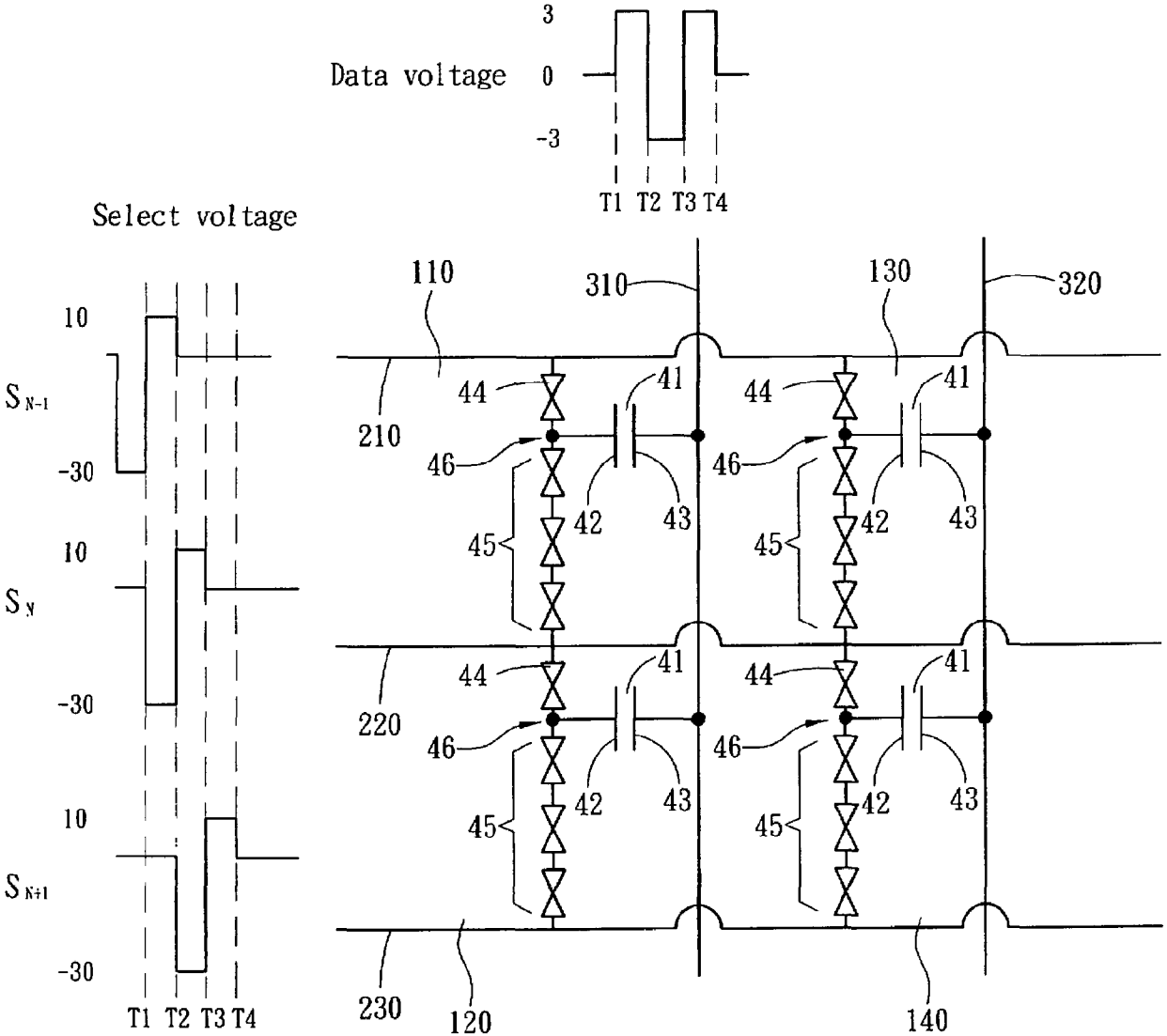
FIG. 4 is the schematic diagram for the first embodiment example of the present invention.

Please refer to FIG. 4 that is the schematic diagram for the first embodiment example of the present invention. Take the electrical impedance of the second set of film diodes 45 is three times of the electrical impedance of the first set of film diodes 44 as an example, according to the principle of the driving method of the present invention is that the select signal of the select line is a positive/negative voltage, the ratio of the maximum absolute value of the positive/negative voltage value and the minimum absolute value of the positive/negative voltage value is defined as a positive number, and the positive number is the electrical impedance ratio of the first set of thin film diodes and the second set of thin film diodes or the positive number is the electrical impedance ratio of the second set of thin film diodes and the first set of thin film diodes. The positive voltage of the select signal is 10V, and the negative voltage of the select signal is −30V. Therefore, the voltage of the select signal $S_{N-1}$ on the select line 210 at time T1 is 10V, the voltage of the select signal $S_N$ on the select line 220 is −30V. Because the specifications for each single element of the first set of film diode 44 and the second set of film diode 45 are the same, the two sets of thin film diodes will divide the voltage equally such that the voltage of the node 46 is zero. When at time T1 the voltage of the data signal 310 is 3V, there is a 3V voltage difference produced between the common electrode 43 and the pixel electrode 42 at this time. The 3V voltage difference will drive the liquid crystal molecules of the liquid crystal layer 41 of the pixel 110 between the common electrode 43 and the pixel electrode 42. At the same time, all signals below the select line 230 are 0V.

The voltage of the select signal $S_N$ on the select line 220 at time T2 is 10V, the voltage of the select signal $S_{N+1}$ on the select line 230 is −30V. Hence, the voltage of the node 46 in the pixel 120 is zero. When at time T2 the voltage of the data signal 310 is −3V, at this time there is a 3V voltage difference produced between the common electrode 43 and the pixel electrode 42 of the pixel 120 that is below the pixel 110. Similarly, the 3V voltage difference will drive the liquid crystal molecules of the liquid crystal layer 41. At the same time, the voltage of the select signal $S_{N-1}$ on the select line 210 is 0V. The 3V voltage difference between the node 46 and the common electrode 43 of the pixel 110 is still preserved. Accordingly, the pixel 110 still holds the previous image.

Figure 5:
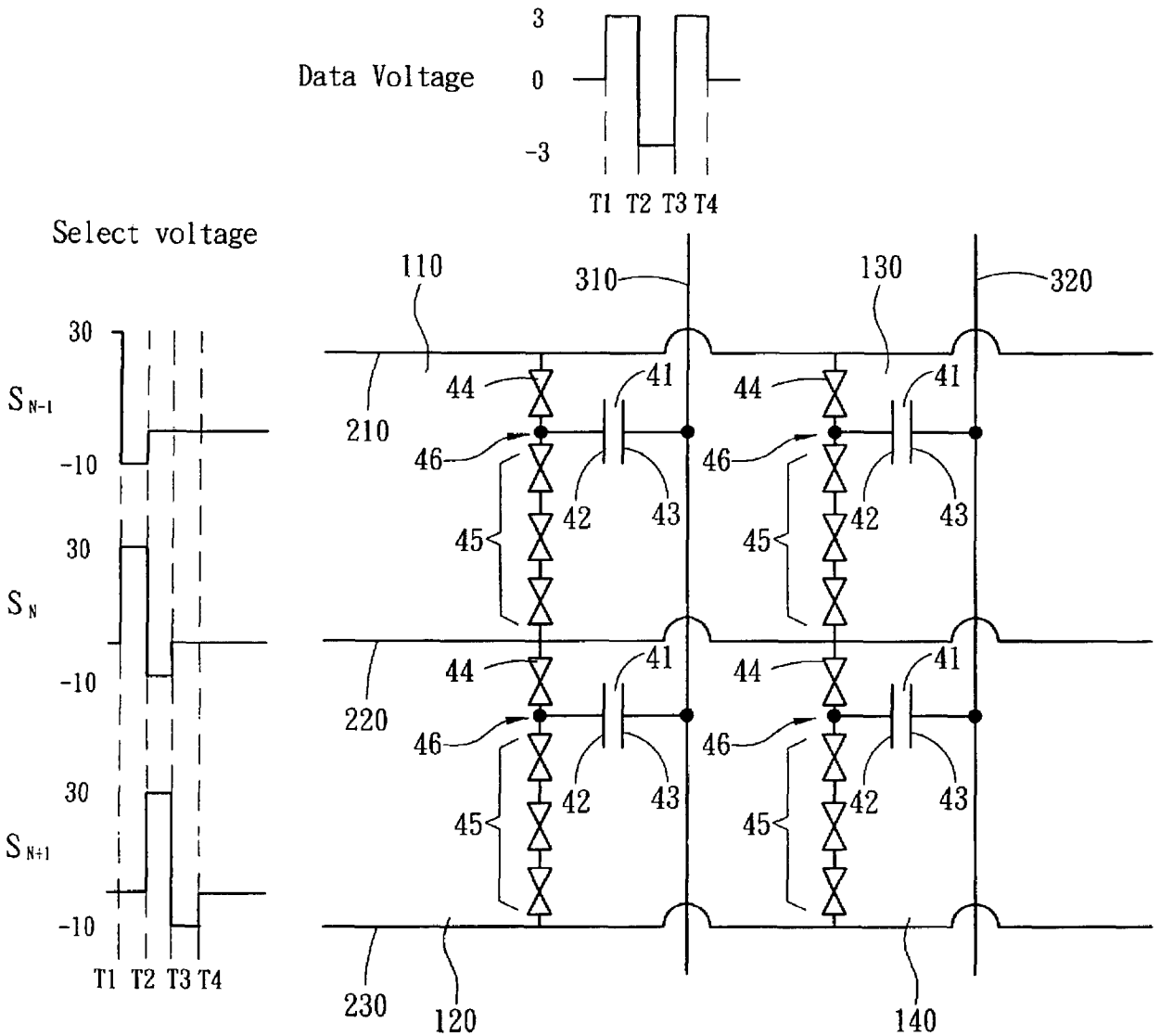
FIG. 5 is the schematic diagram for the second embodiment example of the present invention.

Please refer to FIG. 5 that is the schematic diagram for the second embodiment example of the present invention. The same as the first embodiment example, take the electrical impedance of the second set of film diodes 45 is three times of the electrical impedance of the first set of film diodes 44 as an example. According to the principle of the driving method of the present invention that the select signal of the select line is a positive/negative voltage, the ratio of the maximum absolute value of the positive/negative voltage value and the minimum absolute value of the positive/negative voltage value is defined as a positive number, and the positive number is the electrical impedance ratio of the first set of thin film diodes and the second set of thin film diodes or the positive number is the electrical impedance ratio of the second set of thin film diodes and the first set of thin film diodes. The negative voltage of the select signal is −10V, and the positive voltage of the select signal is 30V. Therefore, the voltage of the select signal $S_{N-1}$ on the select line 210 at time T1 is −10V, the voltage of the select signal $S_N$ on the select line 220 is 30V. Because the specifications for each single element of the first set of film diodes 44 and the second set of film diode 45 are the same, so the two sets of thin film diodes will divide the voltage equally such that the voltage of the node 46 is zero. When at time T1 the voltage of the data signal 310 is 3V, there is a 3V voltage difference produced between the common electrode 43 and the pixel electrode 42 at this time. The 3V voltage difference will drive the liquid crystal molecules of the liquid crystal layer 41 of the pixel 110 between the common electrode 43 and the pixel electrode 42. At the same time, all signals below the select line 230 are 0V.

The voltage of the select signal $S_N$ on the select line 220 at time T2 is −10V, the voltage of the select signal $S_{N+1}$ on the select line 230 is 30V. Hence, the voltage of the node 46 in the pixel 120 is zero. When at time T2 the voltage of the data signal 310 is −3V, at this time there is a 3V voltage difference produced between the common electrode 43 and the pixel electrode 42 of the pixel 120 that is below the pixel 110. Similarly, the 3V voltage difference will rotate the liquid crystal molecules of the liquid crystal layer 41. At the same time, the voltage of the select signal $S_{N-1}$ on the select line 210 is 0V; the 3V voltage difference between the node 46 and the common electrode 43 of the pixel 110 is still preserved. Accordingly, the pixel 110 still holds the previous image.

To sum up the aforementioned structure and driving method, the present invention can reduce the quantity of select lines. In contrast to the method depicted in U.S. Pat. No. 6,222,596, the present invention can reduce half number of channels. Merely because reducing the number of channels will reduce the needed number of ICs, the following manufacturing process for IC bonding for panels becomes more convenient, the manufacturing cost is lower effectively, the manufacturing difficulty is reduced, and the design complexity is also decreased. Furthermore, reducing the quantity of channels on the panel will promote the whole aperture rate and resolution, and substantially reduces the problem of incomplete etching of a general channel. As a result, the yield rates can be promoted.

However, the above description is only a better practice example for the current invention, which is not used to limit the practice scope of the invention. All equivalent changes and modifications based on the claimed items of the present invention are in the scope of the present invention.

What is claimed is:

1. A structure for active photoelectric element, which aims to every matrix-arranged pixel on the display panel, comprising:

a common electrode, a pixel electrode, and a liquid crystal layer between the two electrodes, which forms a pixel storage capacitor, and the common electrode connects to a data line;

a set of first thin film diodes and a set of second thin film diodes, the first set of film diodes and the second set of film diode connected at a node, the pixel electrode also connecting to the node, and the electrical impedance of the first set of film diodes and the electrical impedance of the second set of film diode being different; and a select line and the data line being perpendicular to each other, wherein the other terminal of the first set of film diode connects to the select line while the other terminal of the second set of film diodes connects to the select line of the pixel on the next row, which forms a configuration that the up/down pixels share one select line;

wherein the second set of thin film diodes is 1~5 times of the electrical impedance of the first set of thin film diodes.

2. The structure for active photoelectric element of claim 1, wherein first set of film diodes and the second set of film diodes are nonlinear resistive diodes with a metal-insulator-metal (MIM) structure.

3. A driving method for active photoelectric element, which aims to every matrix-arranged pixel on the display panel, comprising:

a common electrode and a pixel electrode, and a liquid crystal layer between the two electrodes, which forms a pixel storage capacitor, and the common electrode connects to a data line;

a set of first thin film diodes and a set of the second thin film diodes, the first set of film diodes and the second set of film diodes connected at a node, and the pixel electrode also connecting to the node, and; the electrical impedance of the first set of film diodes and the electrical impedance of the second set of film diode being different;

a select line and the data line being perpendicular to each other, wherein the other terminal of the first set of film diodes connects to the select line while the other terminal of the second set of film diodes connects to the select line of the pixel on the next row; and the driving method including:

select signal of the select line being a positive/negative voltage, the ratio of the maximum absolute value of the positive/negative voltage value and the minimum absolute value of the positive/negative voltage value being defined as a positive number, and the positive number being the electrical impedance ratio of the first set of thin film diodes and the second set of thin film diodes or the positive number being the electrical impedance ratio of the second set of thin film diodes and the first set of thin film diodes;

wherein the second set of thin film diodes is 1~5 times of the electrical impedance of the first set of thin film diodes.

4. The driving method for active photoelectric element of claim 3, wherein the first set of film diodes and the second set of film diodes are nonlinear resistive diodes with a MIM structure.

* * * * *